US009961934B2

(12) United States Patent
Zhao et al.

(10) Patent No.: US 9,961,934 B2
(45) Date of Patent: May 8, 2018

(54) METHOD FOR THRESHING AND PNEUMATIC SEPARATION OF TOBACCO LEAVES

(71) Applicant: HONGTA TOBACCO (GROUP) CO., LTD., Yuxi (CN)

(72) Inventors: Yunchuan Zhao, Yuxi (CN); Quan Zou, Yuxi (CN); Wen Pan, Yuxi (CN); Yanbin Yang, Yuxi (CN); Junping Lu, Yuxi (CN); Ran Chen, Yuxi (CN); Wenhui Qi, Yuxi (CN); Dingrong Mou, Yuxi (CN); Yi Wang, Yuxi (CN); Liwu Wang, Yuxi (CN); Wen Liu, Yuxi (CN); Jun Yang, Yuxi (CN); Xi'e Wang, Yuxi (CN); Ming Zhou, Yuxi (CN)

(73) Assignee: HONGTA TOBACCO (GROUP) CO., LTD., Yuxi (CN)

( * ) Notice: Subject to any disclaimer, the term of this patent is extended or adjusted under 35 U.S.C. 154(b) by 238 days.

(21) Appl. No.: 14/965,886

(22) Filed: Dec. 10, 2015

(65) Prior Publication Data

US 2016/0095346 A1 Apr. 7, 2016

Related U.S. Application Data

(63) Continuation-in-part of application No. PCT/CN2014/079652, filed on Jun. 11, 2014.

(30) Foreign Application Priority Data

Jun. 11, 2013 (CN) ..... 2013 1 0230300

(51) Int. Cl.
*A24B 5/06* (2006.01)
*A24B 5/12* (2006.01)
(Continued)

(52) U.S. Cl.
CPC ..... *A24B 5/06* (2013.01); *A24B 5/12* (2013.01); *B07B 4/08* (2013.01); *B07B 9/02* (2013.01); *B07B 11/06* (2013.01)

(58) Field of Classification Search
CPC ..... B07B 11/06; B07B 11/02; B07B 11/04; A24B 5/06; A24B 5/12; A24B 5/10;
(Continued)

(56) References Cited

U.S. PATENT DOCUMENTS 1,593,688 A * 7/1926 Brashear ..... A24B 5/12 131/313
1,879,016 A * 9/1932 Austin ..... A24B 5/10 131/110
(Continued)

FOREIGN PATENT DOCUMENTS

CN 102813277 A * 12/2012 ..... B07B 9/02
EP 2881001 A1 * 6/2015 ..... A24B 5/10

OTHER PUBLICATIONS

Chapter 31. The Stemming or Threshing and Air Separation of Tobacco.. 1981. RJ Reynolds Records. Unknown. https://www.industrydocumentslibrary.ucsf.edu/tobacco/docs/nngm0074.*
(Continued)

*Primary Examiner* — Seyed Masoud Malekzadeh
*Assistant Examiner* — Taryn Trace Willett
(74) *Attorney, Agent, or Firm* — Matthias Scholl, PC; Matthias Scholl

(57) ABSTRACT

A method for threshing and pneumatic separation of tobacco leaves, including: 1) transporting a mixture of the tobacco slices and stems from a primary threshing set into primary pneumatic separation unit for sorting out tobacco slices, and transporting a remaining mixture into a secondary threshing set; 2) transporting the mixture from the secondary threshing set into a secondary pneumatic separation unit for sorting
(Continued)

out the tobacco slices and qualified stems, and transferring a remaining mixture to a tertiary threshing set; 3) transporting the mixture from the tertiary threshing set into a tertiary pneumatic separation unit for sorting out the tobacco slices and the qualified stems, and transferring a remaining mixture into a quaternary threshing set; 4) transporting the mixture from the quaternary threshing set into a quaternary pneumatic separation unit for sorting out the tobacco slices and the qualified stems, and returning a remaining mixture to the quaternary threshing set.

11 Claims, 4 Drawing Sheets

(51) Int. Cl.
*B07B 4/08* (2006.01)
*B07B 11/06* (2006.01)
*B07B 9/02* (2006.01)

(58) Field of Classification Search
CPC .... A24B 5/08; A24B 5/16; A24B 7/14; A24B 13/00; A24B 13/02; A24B 3/16; A24B 3/00; A24B 3/07; A24B 3/08; A24B 1/04
USPC ..... 131/312, 110
See application file for complete search history.

(56) References Cited

U.S. PATENT DOCUMENTS 3,043,315 A * 7/1962 Verhappen ..... A24B 5/10 131/312
3,128,775 A * 4/1964 Eissmann ..... A24B 5/10 131/312
3,513,858 A * 5/1970 Pietrucci ..... A24B 5/10 131/312
3,661,159 A * 5/1972 Pietrucci ..... A24B 5/10 131/312
4,162,768 A * 7/1979 Froats ..... B03B 1/00 162/4
4,237,909 A * 12/1980 Jenkins, Jr. ..... A24B 5/06 131/319
4,273,140 A * 6/1981 Eijsermans ..... A24B 5/04 131/314
4,449,540 A * 5/1984 Marshall ..... A24B 3/18 131/290
4,566,470 A * 1/1986 Brackmann ..... A24B 3/18 131/290
4,696,312 A * 9/1987 Turano ..... A24B 3/07 131/109.1
5,005,770 A * 4/1991 Suessegger ..... B02C 23/32 241/152.2
5,016,823 A * 5/1991 Kato ..... B07B 7/0865 209/143
5,024,334 A * 6/1991 Misra ..... B03B 4/00 209/467
5,026,322 A * 6/1991 Tognana ..... A24B 5/10 460/134
5,099,863 A * 3/1992 Coleman ..... A24B 1/04 131/312
5,205,415 A * 4/1993 Surtees ..... A24B 5/10 131/312
5,394,893 A * 3/1995 Coleman ..... A24B 5/10 131/109.2
5,538,017 A * 7/1996 Webb ..... A24B 5/10 131/110
6,394,098 B1 * 5/2002 Cunningham ..... A24B 5/10 131/311
6,435,191 B1 * 8/2002 Roudabush ..... A24B 5/10 131/108
6,481,441 B1 * 11/2002 Cunningham ..... A24B 5/10 131/313
9,095,172 B2 * 8/2015 Salmon ..... A24B 5/10
2008/0229985 A1 * 9/2008 Magaldi ..... F23C 9/06 110/344

OTHER PUBLICATIONS

English translation of CN 102813277 A, provided by Google Patents.*

* cited by examiner

METHOD FOR THRESHING AND PNEUMATIC SEPARATION OF TOBACCO LEAVES

CROSS-REFERENCE TO RELATED APPLICATIONS

This application is a continuation-in-part of International Patent Application No. PCT/CN2014/079652 with an international filing date of Jun. 11, 2014, designating the United States, now pending, and further claims priority benefits to Chinese Patent Application No. 201310230300.4 filed Jun. 11, 2013. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The invention relates to a method for threshing and pneumatic separation of tobacco leaves.

Description of the Related Art

Conventional technologies of threshing and pneumatic separation of tobacco leaves lead to dramatic temperature drop and moisture loss of material, leads to the reduction of the ratio of larger slice size as well as of medium slice size and the increasing of the broken rate. The remaining stems after each separating step sequentially pass through all of the series threshing machines and the pneumatic separators before discharging in concentration, resulting reducing the availability of the stems, and the span of the pipes of the airborne devices is so wide that it is prone to bring up the poor transportation stability and the phenomenon of caulking, not to mention high energy consumption and big noise with the fan.

SUMMARY OF THE INVENTION

The purpose of the invention is to solve the defects of the prior art, to provide an original technology and arrangement for threshing and pneumatic separation with high efficiency and energy conservation, which has transformed the equipment arrangement and the process flow of the traditional threshing and pneumatic separation equipment, adopting the belt conveyor as a substitute of the original airborne device, adopting an original binary silos pneumatic separators combined as the primary pneumatic separation unit, and adopting an original triple silos pneumatic separators combined as the secondary, tertiary, and quaternary pneumatic separation unit.

A method for threshing and pneumatic separation of tobacco leaves, comprises:

1) transferring heated and humidified tobacco leaves after a secondary conditioning process into a silo feeder via a feeding belt conveyor and a scraper feeder for balancing a feeding flow; evenly distributing the tobacco leaves by a proportion distributor into each threshing machine of a primary threshing set so as to rip tobacco slices and stems; transporting a mixture of the tobacco slices and the stems coming out of the primary threshing set into each branch of a primary pneumatic separation unit respectively; transporting qualified tobacco slices separated by the branches of the primary pneumatic separation unit onto a slice collection belt conveyor; and transporting a remaining mixture into a secondary threshing set;

2) collecting and transporting the mixture of tobacco slices and the stems coming out of the secondary threshing set into each branch of a secondary pneumatic separation unit; transporting the qualified tobacco slices and the qualified tobacco stems separated by the branches of the secondary pneumatic separation unit onto the slice collection belt conveyor and a stem-collected belt conveyor, respectively, and transferring a remaining mixture to a tertiary threshing set;

3) collecting and transporting the mixture of the tobacco slices and the stems coming out of the tertiary threshing set into a branch of a tertiary pneumatic separation unit; transporting the qualified tobacco slices and the qualified tobacco stems separated by the branch of the tertiary pneumatic separation unit onto the slice collection belt conveyor and the stem-collected belt conveyor, respectively, and transferring a remaining mixture into a quaternary threshing set; and 4) transporting the mixture of the tobacco slices and the stems coming out of the quaternary threshing set to a branch of a quaternary pneumatic separation unit; transferring the qualified tobacco slices and the qualified tobacco stems separated by the branch of the quaternary pneumatic separation unit onto the slice collection belt conveyor and the stem-collected belt conveyor, respectively, and returning a remaining mixture from the quaternary pneumatic separation unit to the quaternary threshing set.

The primary pneumatic separation unit is provided with air pressure type binary silos pneumatic separators for sorting out the qualified tobacco slices. The secondary pneumatic separation unit, the tertiary pneumatic separation unit, and the quaternary pneumatic separation unit are provided with air pressure type triple silos pneumatic separators for sorting out the qualified tobacco slice and the qualified tobacco stems.

Each threshing machine of the primary threshing set is respectively communicated, through the correspondent belt conveyer, with each branch of the primary pneumatic separation unit. The branches of the primary separation unit, as well as the secondary separation unit, are parallel arranged, each branch thereof consists of one or more tandem pneumatic separator and respectively communicated, through the correspondent belt for tobacco leaves with stem, with one threshing machine of the next stage threshing set; as for the secondary and tertiary threshing set, every two threshing machines are yet communicated through the belt conveyer with one branch of individual pneumatic separator of the same stage pneumatic separation unit. The binary silos pneumatic separator comprises a separation silo, a discharge silo, a shared upper sidewall of the separation silo communicated with the discharge silo through a communication port, where an air curtain is disposed to isolate the silos from each other, a discharge port disposed at the bottom of the discharge silo, a suction outlet mounted on the top of the separation silo, a feeding port disposed at the lower part of a sidewall of the separation silo, which is precisely facing towards the underside of the end of the belt conveyer, a vibration trough arranged at the lower part of the separation silo, a damper plate disposed underside thereof, a draft inlet located underbelly thereof at the bottom of the separation silo, a rejection outlet installed at the underside end of the vibrating trough; the mesh belt conveyer is horizontally arranged in the separation working silo and the discharge silo, which contains an air curtain taking the structure with a communication port, where an auxiliary draft inlet is provided, on the topside of which a series of air holes disposed, which is vertically facing the mesh belt conveyer; the discharge silo has a trumpet shape of which the upper part is bigger than the lower, tilt sidewalls of which are provided with angle regulators, the damper plate adopts pull chute, which is mounted beneath the mesh vibrating trough.

The triple silos pneumatic separator comprises the suction outlet, belt conveyer, feeding port, the primary air inlet, the primary auxiliary draft inlet, the primary rejection port, the secondary air inlet, the secondary rejection port, the discharge port, the scratch brush, the discharge silo, the secondary separation silo, and the secondary auxiliary draft inlet; the primary separator silo is communicated, through a passage on the shared upper sidewall, with the secondary separator silo, which just is communicated, through a passage on the shared upper sidewall, with the discharge silo, forming a structure of communication in series of triple silos; the belt conveyer is horizontally disposed on the upside of the feeding port, and mounted in the triple silos through the communication ports, whereof is provided with the air curtain to isolate the adjacent silos from each other, which are the primary separation silo, the secondary thereof, and the discharge silo, respectively; the discharge port is disposed at the bottom of the discharge silo; the suction outlet is provided on the top of each separation silo respectively; a feeding port is disposed at the lower part of a sidewall of the primary separation silo, which is plumb in the face of the underside of one end of the belt conveyer; a vibration trough with meshes is arranged at the lower part of the primary and secondary separation silo, a damper plate disposed underside thereof, an air inlet located underbelly thereof dead over against the bottom port of each separation silo, a rejection outlet installed at the underside end of the vibrating trough; the structure of air curtain is that the communication port between the primary and the secondary separation silo is installed the primary auxiliary air inlet, the communication port between the secondary separation silo and the discharge silo is mounted the secondary auxiliary air inlet, each auxiliary air inlet is provided with a series of vertical air outlet dead over against the belt conveyer, the discharge silo has a trumpet shape of which upper part is bigger than lower part, tilt sidewalls of which are provided with angle regulators, the damper plate adopts pull chute, which is mounted beneath the mesh vibrating trough.

By replacing the damper plate, which is located at the lower part of the primary separation silo or the secondary separation silo, the velocity of the positive pressure air flowing into silos thereof can be adjusted with a result of the air profile of the respective separation silo presenting different air pressure and velocity, causing the adjacent silos being in different pressure. The primary separation silo is different from the secondary separation silo, which is different from the discharge silo.

The invention adopts the perpendicular angle bending structure, so that the pressure-balanced plane in each separation silo take forms with low pressure on the right, high on the left respectively, each separation silo has a trumpet shape of which upper part is bigger than lower part, tilt sidewalls of which are provided with angle regulators, the damper plate adopts pull chute, which is mounted beneath the mesh vibrating trough.

Each separation silo of the triple silos pneumatic separator are in the state, which takes positive pressure on the upper side, and negative pressure on the lower side, which are used for realizing the quaternary material separation by separation silos thereof, and the pressure equilibrium plane thereof can be adjusted. The adjacent primary and secondary separation silo are isolated from each other by a separator plate, as well as the secondary silo from the discharge silo, and are communicated with material passage.

The pressure at the suction outlet is 100-2100 Pa lower than the standard atmospheric pressure, the pressure at the mesh on the vibrating trough is 100-2000 Pa higher than the standard atmospheric pressure, the draft inlet connected to the underbelly of the damper plate takes a rectangular bending structure, the airflow direction of the horizontal section of which is consistent with the transferring direction of the mesh belt conveyer, and the pressure in the discharge silo is equal to the standard atmospheric pressure.

At the end of the mesh belt conveyer located in the discharge silo is provided with a scratch brush, and the mesh belt conveyer is equipped with corrective and tensioning means.

The process procedures consist sequentially of as the followings: the scraper feeder, silo feeder, and proportion distributor are connected in series by belt conveyer, then communicated with the primary threshing set, which is comprised of four parallel connected threshing machines.

The discharge ports of each threshing machine are connected through the belt conveyer to the correspondent part of the primary pneumatic separator unit, which is comprised of four binary silos pneumatic separators.

The discharge ports of each binary silos pneumatic separator in the primary pneumatic separator unit are communicated through the belt conveyer with the secondary threshing set, which is, through the belt conveyer, communicated with the secondary pneumatic separator unit which is comprised of two triple silos pneumatic separators.

The discharge ports of each triple silos pneumatic separators in the secondary pneumatic separator unit are connected through the belt conveyer to the tertiary threshing set, which is, through the belt conveyer, communicated with the tertiary pneumatic separator unit which is comprised of single triple silos pneumatic separator.

The discharge port of triple silos pneumatic separator is connected through the belt conveyer to the quaternary threshing set, which is, through the belt conveyer, communicated with the quaternary pneumatic separator unit which adopts a triple silos pneumatic separator.

The each pneumatic separator of the pneumatic separator units at different stage above mentioned is respectively communicated, through the belt conveyer for tobacco stem, thereof for tobacco slice, and thereof for tobacco leaves with stem, with the each threshing machine of the threshing units at different stage above mentioned.

The invention has the advantages of:

1. Adopting of the original (binary silos, triple silos) pneumatic separators, transforming the traditional airborne by pipeline into the transport manner with the belt conveyer and the vibrating trough, being not prone to caulking, reducing temperature drop, moisture loss, and the further shredding of the tobacco material.

2. The invention has transformed the equipment arrangement and the process flow of the traditional threshing and pneumatic separation equipment, the coordination manners of the thrashing machines and the pneumatic separators can be flexibly arranged, leading to increasing the output of the ratio of larger size tobacco slice as well as medium size, improving the availability of the tobacco stems.

3. As the transmission power of the technology and arrangement pertaining to the invention is low, the energy consumption and noises thereof are minimized dramatically.

BRIEF DESCRIPTION OF THE DRAWINGS

In FIG. 2, 1. Belt conveyer for feeding, 2. Scraper feeder, 3. Silo feeder, 4. Proportional distributor, 5. Primary threshing set, 6. Belt conveyer, 7. Primary pneumatic separation unit (binary silos pneumatic separator), 8. Belt conveyer for tobacco slice, 9. Binary silos pneumatic separator, 10. Belt conveyer for tobacco leaves with stem, 11. Secondary threshing set, 12. Belt conveyer, 13. Belt conveyer, 14. Belt conveyer, 15. Secondary pneumatic separation unit (triple silos pneumatic separator), 16. Belt conveyer for tobacco stem, 17. Triple silos pneumatic separator, 18. Belt conveyer for tobacco slice, 19. Belt conveyer for tobacco leaves with stem, 20. Tertiary threshing set, 21. Belt conveyer, 22. Belt conveyer, 23. Belt conveyer, 24. Tertiary pneumatic separation unit (a triple silos pneumatic separator), 25. Belt conveyer for tobacco stem, 26. Triple silos pneumatic, 27. Belt conveyer for tobacco slice, 28. Belt conveyer for tobacco leaves with stem, 29. Quaternary threshing set, 30. Belt conveyer, 31. Quaternary pneumatic separation unit (a triple silos pneumatic separator), 32. Belt conveyer for tobacco stem, 33. Belt conveyer for tobacco leaves with stem, 34. Belt conveyer, 35. Belt conveyer, 36. Belt conveyer for tobacco slice, 37. Belt conveyer for collecting tobacco slice, 38. Belt conveyer for collecting tobacco stem.

As shown in FIG. 3, 9*a*—Belt conveyer with high velocity, 9*b*—Centrifugal ventilator, 9*c*—Separation silo, 9*d*—Belt conveyer, 9*e*—Suction outlet, 9*f*—Auxiliary air inlet, 9*g*—Discharge silo, 9*h*—Vibrating trough, 9*i*—Discharge port, 9*j*—Rejection outlet, 9*k*—Damper plate, 9*n*—Air inlet.

As shown in FIG. 4, 17*k*1—Damper plate, 17*k*2—Damper plate, 17*j*1—Primary rejection port, 17*j*2—Secondary rejection port, 17*i*—Discharge port, 17*c*1—Primary separation silo, 17*c*2—Secondary separation silo, 17*d*—Mesh belt conveyer, 17*a*—Suction outlet, 17*f*1—Primary auxiliary air inlet, 17*f*2—Secondary auxiliary air inlet.

DETAILED DESCRIPTION OF THE EMBODIMENTS

Figure 4:
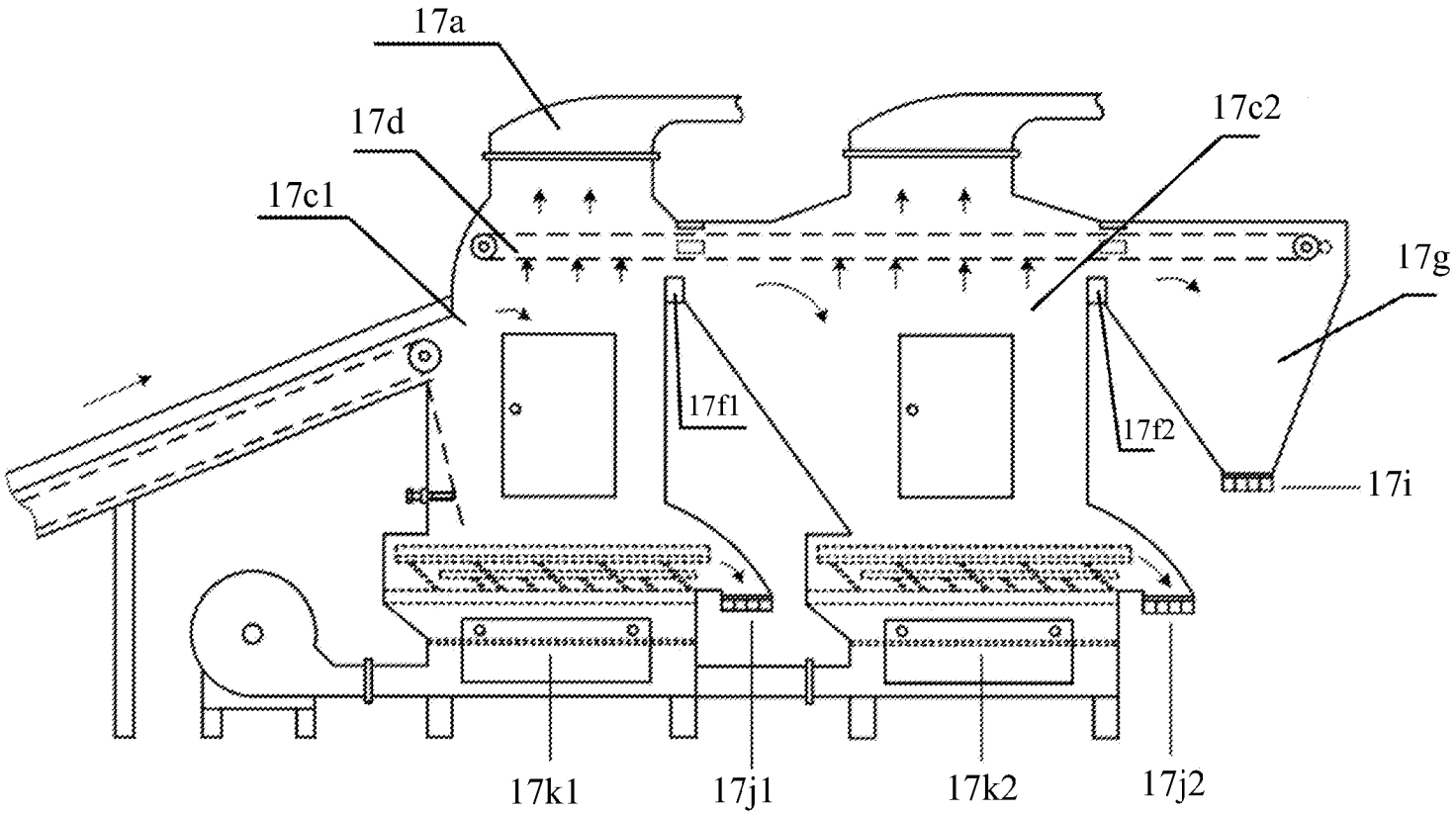
FIG. 4 is a constructed profile view of the triple silos pneumatic separator in the invention.

As shown in the FIG. 4 with the traditional process flow view of the traditional threshing and pneumatic separation procedure, the mixture of the tobacco leaves and stems, which are shredded by the threshing set, is transported by airborne devices to several series pneumatic separators carrying out the air separation. Each pneumatic separator can just sort out some parts of the qualified tobacco slice, and the remaining mixture continues to be transferred in the airborne device. The tobacco stems are discharged at the last pneumatic separator, resulting in heavy loads of pneumatic separator and threshing machine, the high energy consumption of airborne devices, and poor applicability of tobacco stem.

The invention is connected sequentially as the following, scraper feeder→silo feeder→proportional distributor→primary threshing set→belt conveyer→primary pneumatic separation unit (binary silos pneumatic separator)→belt conveyer for tobacco leaves with stem→secondary threshing set→belt conveyer→secondary pneumatic separation unit (triple silos pneumatic separator)→belt conveyer for tobacco leaves with stem→tertiary threshing set→belt conveyer→tertiary pneumatic separation unit (a triple silos pneumatic separator)→belt conveyer for tobacco leaves with stem→quaternary threshing set→belt conveyer→quaternary pneumatic separation unit (a triple silos pneumatic separator).

The symbol "→" represents two adjoining processes interconnected and immediate adjacent devices mutually communicated.

The original arrangement for threshing and pneumatic separation with high efficiency and energy conservation as above mentioned, is sequentially connected as the followings: the scraper feeder 2, silo feeder 3, and proportion distributor 4 are connected in series by belt conveyer, then communicated with the primary threshing set 5, which is comprised of four parallel connected threshing machines.

The discharge ports of each threshing machine are connected through the belt conveyer to the correspondent part of the primary pneumatic separator unit 7, which is comprised of four binary silos pneumatic separators 9.

The discharge ports of each binary silos pneumatic separator in the primary pneumatic separator unit 7 are communicated through the belt conveyer with the secondary threshing set 11, which is, through the belt conveyer, communicated with the secondary pneumatic separator unit 15 which is comprised of two triple silos pneumatic separators 17.

The discharge ports of each triple silos pneumatic separators 17 in the secondary pneumatic separator unit 15 are connected through the belt conveyer to the tertiary threshing set 20, which is, through the belt conveyer, communicated with the tertiary pneumatic separator unit 24 which is comprised of single triple silos pneumatic separator 26.

The discharge port of triple silos pneumatic separator 26 is connected through the belt conveyer to the quaternary threshing set 29, which is, through the belt conveyer, communicated with the quaternary pneumatic separator unit 31 which adopts a triple silos pneumatic separator.

The each pneumatic separator of the pneumatic separator units at different stage above mentioned is respectively communicated, through the belt conveyer for tobacco stem, thereof for tobacco slice, and thereof for tobacco leaves with stem, with the each threshing machine of the threshing units at different stage above mentioned, each threshing machine of the primary threshing set is respectively communicated, through the correspondent belt conveyer, with each branch of the secondary pneumatic separation unit, the branches of the primary separation unit, as well as the secondary separation unit, are parallel arranged, each branch thereof is consists of one or more tandem pneumatic separator and respectively communicated, through the correspondent belt for tobacco leaves with stem, with one threshing machine of the next stage threshing set.

As for the secondary and tertiary threshing set, every two threshing machines are yet communicated through the belt conveyer with one branch of individual pneumatic separator of the next stage pneumatic separation unit. The primary pneumatic separation unit, is provided with air pressure type binary silos pneumatic separator, can only sort out qualified tobacco slice, the secondary-, tertiary-, and quaternary pneumatic separation unit, is provided with air pressure type triple silos pneumatic separator, can sort out qualified tobacco slice and tobacco stem.

Specifically, the velocity of the positive pressure of the air inlet at the bottom of the separation silo in the involved binary silos pneumatic separator, is adjusted by the damper plate located at the air inlet, leads to the position of the air equilibrium surface can being adjusted up and down, making the thrown tobacco mixture from the feeding port separated, the heavier stems fall on the vibrating trough mounted at the bottom of the separation silo and are transported out of the rejection port, the lighter by the effect of the negative pressure are absorbed on the belt conveyor installed on the top of the separator silo, which are transferred into the discharge silo with the operation of the belt conveyor. Since the air pressure inside the discharge silo is the same with the outside air pressure, in its own inertia, the lighter tobacco slices fall in a parabolic path to the discharge port and are discharged, the fine dust and the debris, whose size is less than the mesh aperture dimension, are effected by the negative pressure and infiltrate the mesh belt conveyor and the suction outlet into the dust exhaust removal system.

Specifically, the involved binary silos pneumatic separator possesses two serial separator silos and one discharge silo, an auxiliary air inlet is installed at the upper side of the intervals of the every two adjacent silos, the position of the air equilibrium surface thereof is regulated differently, the heavier tobacco stems are transported out of the first rejection port at the lower part of the primary separation silo, yet the lighter stems are transported out of the second rejection port at the lower part of the secondary separation silo, the lighter tobacco slices are sent out at the discharge port of the discharge silo, the fine dust and the debris, whose size is less than the mesh aperture dimension, are effected by the negative pressure and infiltrate the mesh belt conveyor and the suction outlet into the dust exhaust removal system.

Example 1

Figure 1:
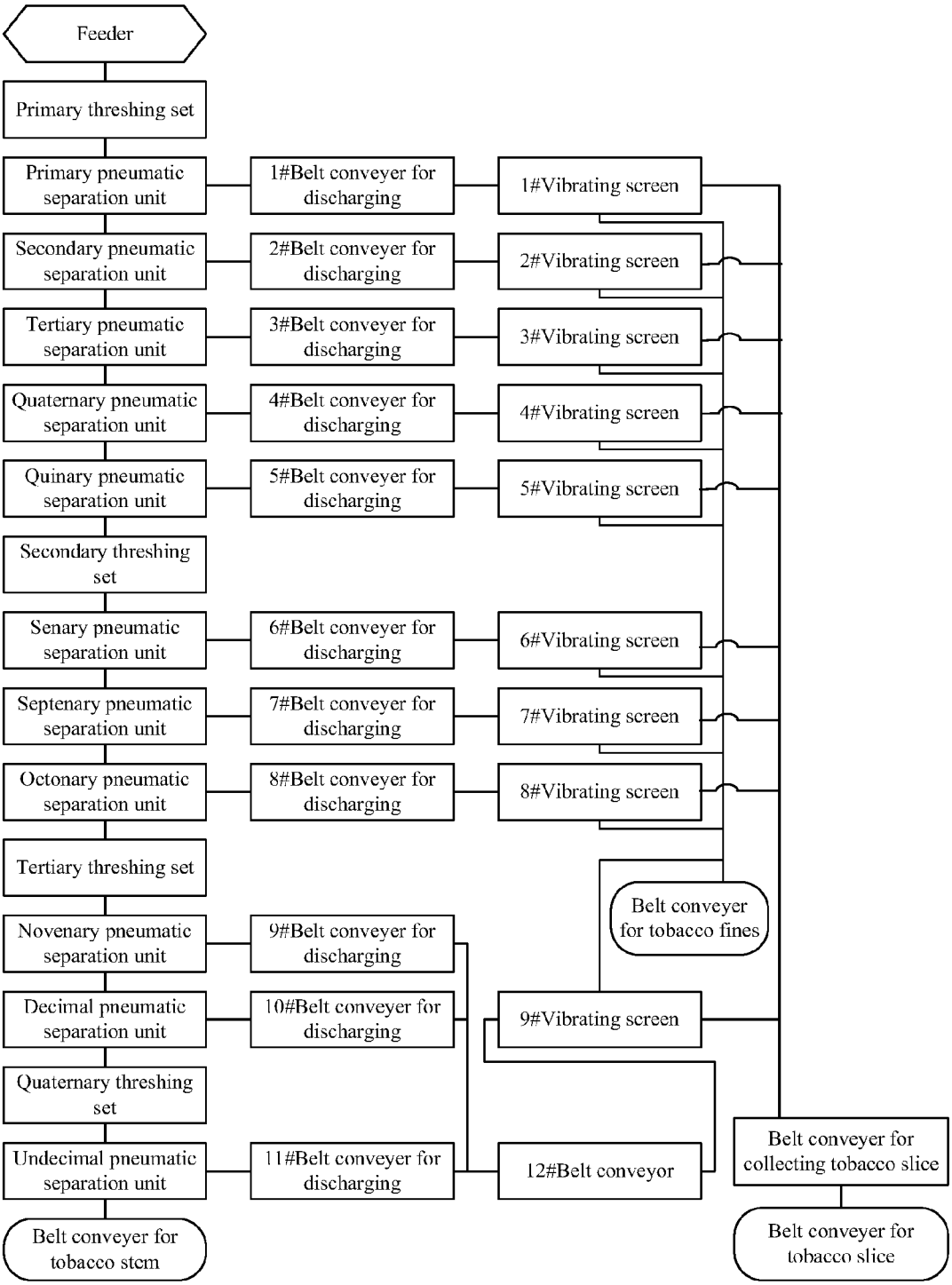
FIG. 1 (Prior art)
FIG. 1 is a process flow view of the traditional threshing and pneumatic device.
Figure 2:
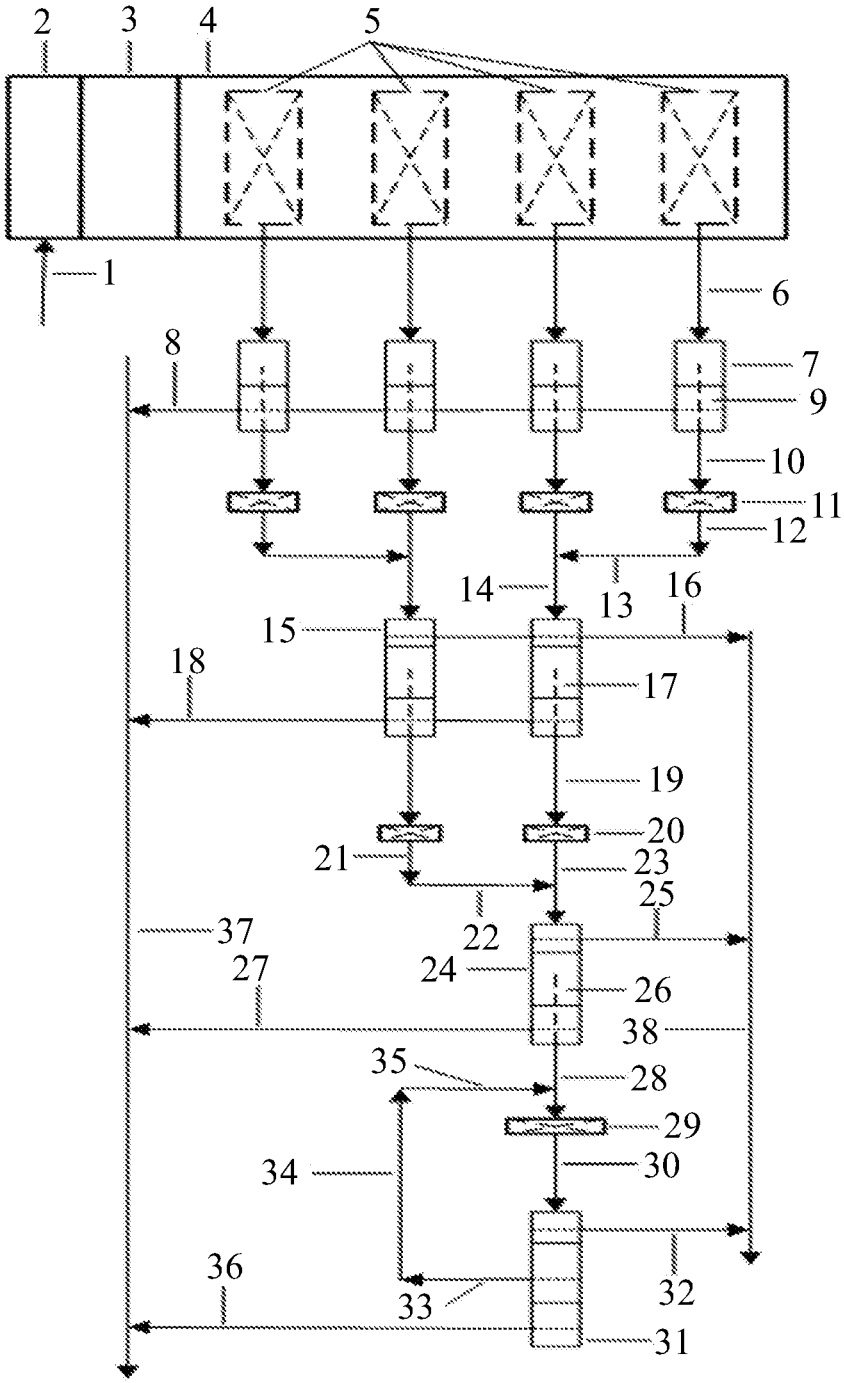
FIG. 2 is a schematic layout view of the original threshing technology and process arrangement pertaining to the invention.

As shown in FIG. 2, after the secondary conditioning process, the heated and humidified tobacco leaves are transferred by the feeding belt conveyor 1 into the scraper feeder 2, then into the silo feeder 3 so balancing the feeding flow, the proportion distributor 4 evenly distribute the tobacco leaves into the each threshing machine of the threshing set to rip the tobacco slices and stems, the mixture of the tobacco slices and stems coming out of the threshing machine is respectively transported by the belt conveyor 6 into each branch of the primary pneumatic separation unit, the sorted tobacco slices separated by the binary silos pneumatic separator 9 drop on the belt conveyor 8, then are transported onto the slice collection belt conveyor 37, the remaining mixture falls on the belt conveyor for the stem-containing tobacco slice 10 and is transferred again into the secondary threshing set 11, the mixture of the tobacco slices and stems coming out of each threshing machine thereof, is collected by the belt conveyors 12, 13, and 14, transported into each branch of the secondary pneumatic separation unit 15, the sorted tobacco slices separated by the triple silos pneumatic separator 17 drop on the belt conveyor 18, then are transported onto the slice collection belt conveyor 37, the qualified stems fall on the belt conveyor for the stem 16, and is transferred to the stem-collected belt conveyor 38, the remaining mixture falls on the stem-containing belt conveyor 19 and is transported into the tertiary threshing set 20, the mixture of the tobacco slices and stems coming out of the two threshing machines of which, is collected by the belt conveyors 21, 22, and 23, transported into each branch of the secondary pneumatic separation unit 24, the sorted tobacco slices separated by the triple silos pneumatic separator 26 drop on the belt conveyor 27, then are transported onto the slice collection belt conveyor 37, the qualified stems fall on the belt conveyor for the stem 25, and is transferred to the stem-collected belt conveyor 38, the remaining mixture falls on the stem-containing belt conveyor 28 and is transported into the quaternary threshing set 29, the mixture of the tobacco slices and stems coming out of which, is transported by the belt conveyor 30 to the branch of the quaternary pneumatic separation unit 31, the sorted tobacco slices separated by the triple silos pneumatic separator drop on the belt conveyor 36, then are transported onto the slice collection belt conveyor 37, the qualified stems fall on the belt conveyor for the stem 32, and is transferred to the stem-collected belt conveyor 38, the remaining mixture falls on the stem-containing belt conveyor 33 and is transported through the belt conveyors 33, 34 back onto the belt conveyor 28.

The involved pneumatic separator binary silos cabin pneumatic separator adopts high-speed belt conveyor to feed the materials at the feeding port, the velocity of belt conveyor is between 2-5 m/s, the air inlet 9*n* of the separation silo and the suction outlet 9*e* are respectively connect to the centrifugal ventilator 9*b* with different capacity, the auxiliary air inlet 9*f* is communicated with the air inlet 9*n*, high-speed belt conveyor 9*a*, ventilator 9*b*, and the motor of the mesh belt conveyor 9*d* are all controlled by frequency conversion speed regulators.

Figure 3:
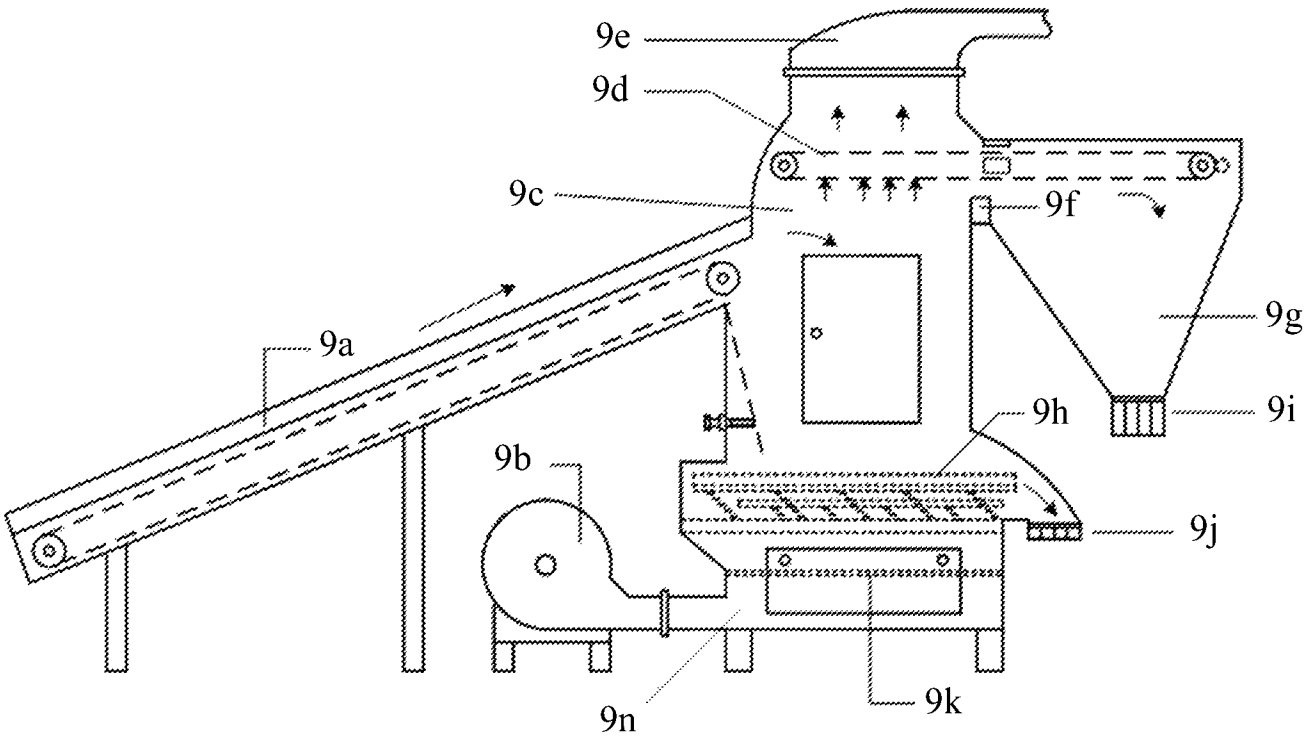
FIG. 3 is a constructed profile view of the binary silos pneumatic separator in the invention.

As shown in FIG. 3, for example, the binary silos operates as the following process, the mixture of the tobacco slices and stems is thrown into the separation silo 9*c* by the high-speed belt conveyer, under the effects of the positive pressure at the bottom of the inlet air 9*n* and the negative pressure to the top of the suction outlet 9*e*, the tobacco slices and stems are separated, the heavier stems containing tobacco leaves fall on the vibrating trough at the lower part of the separation silo, and are sent out at the rejection outlet 9*j*, the lighter tobacco slices are absorbed on the belt conveyer 9*d* with the effect of the negative pressure, which are transferred to the discharge silo with the driving movement of the mesh belt conveyer 9*d*, the tobacco slice thereof, under the effects of positive pressure at the auxiliary air inlet 9*c* and its own inertia, drop in a parabolic path to the discharge port 9*i*, the fine dust and debris, whose size is less than dimension of the mesh aperture on the belt conveyer 9*d*, infiltrate the mesh belt conveyer 9*d* into the dust exhaust system through the suction outlet 9*e*. According to the different input flow of the mixture of the tobacco leaves and stems, the air flow velocity of each binary silos pneumatic separator can be adjusted through regulating the damper plate 9*n*, which is located, where the air inlet 9*n* is, at the bottom of the separator 9*c*, causing to transforming the pressure equilibrium surface of the positive air pressure in the separation 9*c* and the negative air pressure at the suction outlet at the top, making the thrown tobacco mixture sorted out with high quality.

The air pressure type triple silos pneumatic separator possesses two serial separation silos 17*c*1, 17*c*2, and a discharge silo 17*g*, while the heavier tobacco stems are brought out from the first rejection outlet 17*j*1 mounted at the lower part of the first separation silo 17*c*1, from the second rejection outlet 17*j*2 mounted at the lower part of the second separation silo 17*c*2, the heavier tobacco stems with slice are brought out, the lighter tobacco slices are discharged from the discharge port of the discharge silo. The position adjustment of the positive and negative pressure equilibrium surface of the two separation silos thereof, is accomplished by regulating the damper plates of 17*k*1 and 17*k*2. The marked 17*f*1 located at the communication port between the primary and secondary separation silo, is provided with the air curtain isolating these two silos.

After the above mentioned process flow, by the velocity adjustment of the belt conveyer, and the position adjustment of the pressure equilibrium surface in the separation silos, which are part of each binary silos and triples silos pneumatic separators in the primary, secondary, tertiary and quaternary pneumatic separation units, accomplishes the sorting out of the qualified tobacco slices and stems, achieving the purpose of high efficiency and energy conservation of the original technology and arrangement in accordance with the invention.

The invention consequentially connects the devices as follows. The scraper feeder 2, silo feeder 3, and proportion distributor 4 are connected in series by belt conveyer, and then communicated with the primary threshing set 5, which is comprised of four parallel connected threshing machines. The discharge ports of each threshing machine are connected through the belt conveyer to the correspondent part of the primary pneumatic separator unit 7, which is comprised of four binary silos pneumatic separators 9.

The discharge ports of each binary silos pneumatic separator in the primary pneumatic separator unit 7 are communicated through the belt conveyer with the secondary threshing set 11, which is, through the belt conveyer, communicated with the secondary pneumatic separator unit 15 which is comprised of two triple silos pneumatic separators 17.

The discharge ports of each triple silos pneumatic separators 17 in the secondary pneumatic separator unit 15 are connected through the belt conveyer to the tertiary threshing set 20, which is, through the belt conveyer, communicated with the tertiary pneumatic separator unit 24 which is comprised of single triple silos pneumatic separator 26.

The discharge port of triple silos pneumatic separator 26 is connected through the belt conveyer to the quaternary threshing set 29, which is, through the belt conveyer, communicated with the quaternary pneumatic separator unit 31 which adopts a triple silos pneumatic separator.

Each pneumatic separator of the pneumatic separator units at different stage above mentioned is respectively communicated, through the belt conveyer for tobacco stem, thereof for tobacco slice, and thereof for tobacco leaves with stem, with the each threshing machine of the threshing units at different stage above mentioned.

The original technology and arrangement of the invention is concise and clear with the standardized equipment layout, by adopting the belt conveyors, vibrating trough, vibrating screen, and metal belt conveyers with meshes to transport materials, the various devices are organically combined leading to the improvement of the production continuity by the reduction of the possibility of caulking.

In the invention, while the tobacco slices, stems, and etc. are sorted out, the devices such as the threshing set, the pneumatic separation unit gradually decreased in dimension, by the constructive application of the adsorption characteristics of tobacco to being transported with metal mesh belt conveyor, that ensures the moisture content of tobacco slice, improves the rates of the long and medium size tobacco slice.

The invention claimed is:

1. A method for threshing and pneumatic separation of tobacco leaves, the method comprising:

1) transferring heated and humidified tobacco leaves after a secondary conditioning process into a silo feeder via a feeding belt conveyor and a scraper feeder for balancing a feeding flow; evenly distributing the tobacco leaves by a proportion distributor into each threshing machine of a primary threshing set so as to rip tobacco slices and stems; transporting a mixture of the tobacco slices and the stems coming out of the primary threshing set into each branch of a primary pneumatic separation unit respectively; transporting qualified tobacco slices separated by the branches of the primary pneumatic separation unit onto a slice collection belt conveyor; and transporting a remaining mixture into a secondary threshing set;

2) collecting and transporting the mixture of tobacco slices and the stems coming out of the secondary threshing set into each branch of a secondary pneumatic separation unit; transporting the qualified tobacco slices and the qualified tobacco stems separated by the branches of the secondary pneumatic separation unit onto the slice collection belt conveyor and a stem-collected belt conveyor, respectively, and transferring a remaining mixture to a tertiary threshing set;

3) collecting and transporting the mixture of the tobacco slices and the stems coming out of the tertiary threshing set into a branch of a tertiary pneumatic separation unit; transporting the qualified tobacco slices and the qualified tobacco stems separated by the branch of the tertiary pneumatic separation unit onto the slice collection belt conveyor and the stem-collected belt conveyor, respectively, and transferring a remaining mixture into a quaternary threshing set; and 4) transporting the mixture of the tobacco slices and the stems coming out of the quaternary threshing set to a branch of a quaternary pneumatic separation unit; transferring the qualified tobacco slices and the qualified tobacco stems separated by the branch of the quaternary pneumatic separation unit onto the slice collection belt conveyor and the stem-collected belt conveyor, respectively, and returning a remaining mixture from the quaternary pneumatic separation unit to the quaternary threshing set;

wherein the primary pneumatic separation unit is provided with air pressure type binary silos pneumatic separators for sorting out the qualified tobacco slices; and the secondary pneumatic separation unit, the tertiary pneumatic separation unit, and the quaternary pneumatic separation unit are provided with air pressure type triple silos pneumatic separators for sorting out the qualified tobacco slice and the qualified tobacco stems.

2. The method of claim 1, wherein each threshing machine of the primary threshing set is respectively communicated, through a first connection belt conveyor, with each branch of the primary pneumatic separation unit; the branches of the primary pneumatic separation unit, as well as the secondary separation unit, are parallel arranged, each branch of the primary pneumatic separation unit and the secondary separation unit consists of one or more tandem pneumatic separator and is respectively communicated, through a leave collection belt conveyor, with one threshing machine of the next stage threshing set; as for the secondary and tertiary threshing set, every two threshing machines are communicated through a second connection belt conveyor with one branch of individual pneumatic separator of the same stage pneumatic separation unit.

3. The method of claim 1, wherein the binary silos pneumatic separator comprises a separation silo, a discharge silo, a shared upper sidewall of the separation silo communicated with the discharge silo through a communication port, where an air curtain is disposed to isolate the silos from each other, a discharge port disposed at the bottom of the discharge silo, a suction outlet mounted on the top of the separation silo, a feeding port disposed at the lower part of a sidewall of the separation silo, a vibrating trough arranged at the lower part of the separation silo, a damper plate disposed on the underside of the vibrating trough, a draft inlet located at the underbelly of the damper plate at the bottom of the separation silo, a rejection outlet installed at the underside end of the vibrating trough; a mesh-shaped belt conveyor is horizontally arranged in the separation silo and the discharge silo, which contains an air curtain taking the structure with a communication port, where an auxiliary draft inlet is provided, on the topside of which a series of air holes disposed, which is vertically facing the mesh-shaped belt conveyor; the discharge silo has a trumpet shape of which the upper part is bigger than the lower, tilt sidewalls of which are provided with angle regulators, the damper plate adopts pull chute, which is mounted beneath the vibrating trough.

4. The method of claim 1, wherein the triple silos pneumatic separator comprises a suction outlet, a mesh-shaped belt conveyor, a primary separator silo, a feeding port, a primary air inlet, a primary auxiliary draft inlet, a primary rejection port, a secondary air inlet, a secondary rejection port, a discharge port, a scratch brush, a discharge silo, a secondary separation silo, and a secondary auxiliary draft inlet; the primary separator silo is communicated, through a passage on the shared upper sidewall, with the secondary separator silo, which just is communicated, through a passage on the shared upper sidewall, with the discharge silo, forming a structure of communication in series of triple silos; the mesh-shaped belt conveyor is horizontally disposed on the upside of the feeding port, and mounted in the triple silos through communication ports, whereof is provided with an air curtain to isolate the adjacent silos from each other, which are the primary separation silo, the secondary separation silo, and the discharge silo, respectively; the discharge port is disposed at the bottom of the discharge silo; the suction outlet is provided on the top of each separation silo respectively; the feeding port is disposed at the lower part of a sidewall of the primary separation silo, which is disposed at the underside of one end of the mesh-shaped belt conveyor; a vibrating trough with meshes is arranged at the lower part of the primary and secondary separation silo, a damper plate disposed on the underside of the vibrating trough, an air inlet located at the underbelly of the damper plate at the bottom port of each separation silo, a rejection outlet installed at the underside end of the vibrating trough; the structure of air curtain is that the communication port between the primary and the secondary separation silo is connected to the primary auxiliary draft inlet, the communication port between the secondary separation silo and the discharge silo is connected to the secondary auxiliary draft inlet, and each auxiliary draft inlet is provided with a series of vertical air outlet over against the mesh-shaped belt conveyor.

5. The method of claim 4, wherein the discharge silo has a trumpet shape of which upper part is bigger than lower part, tilt sidewalls of which are provided with angle regulators, the damper plate adopts pull chute, which is mounted beneath the vibrating trough.

6. The method of claim 4, wherein by replacing the damper plate, which is located at the lower part of the primary separation silo or the secondary separation silo, the velocity of the positive pressure air flowing into silos thereof can be adjusted with a result of the air profile of the respective separation silo presenting different air pressure and velocity, causing the adjacent silos being in different pressure, the primary separation silo is different from the secondary separation silo, which is different from the discharge silo.

7. The method of claim 4, wherein it adopts the perpendicular angle bending structure, so that the pressure-balanced plane in each separation silo take forms with low pressure on the right, high on the left respectively, each separation silo has a trumpet shape of which upper part is bigger than lower part, tilt sidewalls of which are provided with angle regulators, the damper plate adopts pull chute, which is mounted beneath the vibrating trough.

8. The method of claim 4, wherein each separation silo of the triple silos pneumatic separator are in the state, which takes positive pressure on the upper side, and negative pressure on the lower side, which are used for realizing the quaternary material separation by separation silos thereof, and the pressure equilibrium plane thereof can be adjusted; the adjacent primary and secondary separation silo are isolated from each other by a separator plate, as well as the secondary silo from the discharge silo, and are communicated with material passage.

9. The method of claim 3, wherein the pressure at the suction outlet is 100-2100 Pa lower than the standard atmospheric pressure, the pressure at the mesh on the vibrating trough is 100-2000 Pa higher than the standard atmospheric pressure, the draft inlet connected to the underbelly of the damper plate takes a rectangular bending structure, the airflow direction of the horizontal section of which is consistent with the transferring direction of the mesh-shaped belt conveyor, and the pressure in the discharge silo is equal to the standard atmospheric pressure, the end of the mesh-shaped belt conveyor located in the discharge silo is provided with a scratch brush, and the mesh-shaped belt conveyor is equipped with corrective and tensioning means.

10. The method of claim 4, wherein the pressure at the suction outlet is 100-2100 Pa lower than the standard atmospheric pressure, the pressure at the mesh on the vibrating trough is 100-2000 Pa higher than the standard atmospheric pressure, the draft inlet connected to the underbelly of the damper plate takes a rectangular bending structure, the airflow direction of the horizontal section of which is consistent with the transferring direction of the mesh-shaped belt conveyor, and the pressure in the discharge silo is equal to the standard atmospheric pressure, the end of the mesh-shaped belt conveyor located in the discharge silo is provided with a scratch brush, and the mesh-shaped belt conveyor is equipped with corrective and tensioning means.

11. The method of claim 1, wherein the process procedures consist sequentially of as the followings: the scraper feeder, silo feeder, and proportion distributor are connected in series, then communicated with the primary threshing set, which is comprised of four parallel connected threshing machines, whereof the discharge ports of the threshing machines are connected through a first set of connection belt conveyors to the correspondent part of the primary separation unit which is comprised of four binary silos pneumatic separators, discharge ports of the binary silos pneumatic separators are connected through a first set of leave collection belt conveyors to the secondary threshing set, which is, through a second set of connection belt conveyors, communicated with the secondary pneumatic separation unit which is comprised of two triple silos pneumatic separators, discharge ports of the two triple silos pneumatic separators are connected through a second set of leave collection belt conveyors to the tertiary threshing set, which is, through a first additional connection belt conveyor, communicated with the tertiary pneumatic separation unit which is comprised of a first single triple silos pneumatic separator, discharge port of the first single triple silos pneumatic separator is connected through an additional leave collection belt conveyor to the quaternary threshing set, which is, through a second additional connection belt conveyor, communicated with the quaternary pneumatic separation unit which adopts a second single triple silos pneumatic separator; the pneumatic separators of the pneumatic separation units at different stages are connected to each other through the stem-collected belt conveyor or the slice collection belt conveyor; the pneumatic separators of the pneumatic separation units are connected to the threshing machines of the next stage threshing set through the leave collection belt conveyors.

* * * * *